US005405206A

United States Patent [19]

Bedol

[11] Patent Number: 5,405,206

[45] Date of Patent: Apr. 11, 1995

[54] FINGER-MOUNTED WRITING APPARATUS

[76] Inventor: Mark A. Bedol, 1768 Fillmore Dr., Monterey Park, Calif. 91754

[21] Appl. No.: 737,562

[22] Filed: Jul. 26, 1991

Related U.S. Application Data

[63] Continuation-in-part of Ser. No. 553,429, Jul. 13, 1990, abandoned.

[51] Int. Cl.[6] ..... B43K 23/00; B43K 29/00

[52] U.S. Cl. ..... 401/7; 401/8; 401/202

[58] Field of Search ..... 401/7, 8, 199, 202; 15/443

[56] References Cited

U.S. PATENT DOCUMENTS

| | | | |
|---|---|---|---|
| 198,484 | 12/1877 | Briggs | 401/8 |
| 361,535 | 4/1887 | Merrick . | |
| 372,903 | 11/1887 | Forster . | |
| 391,199 | 10/1888 | Seabaugh . | |
| 488,945 | 12/1892 | Nelson . | |
| 504,918 | 9/1893 | Geissinger . | |
| 684,685 | 10/1901 | Gerst . | |
| 2,509,837 | 5/1950 | Niizawa . | |
| 3,105,260 | 10/1963 | Smith et al. | 401/8 X |
| 3,446,563 | 5/1969 | Burnham | 401/199 |
| 3,887,286 | 6/1975 | Bucey | 401/7 |
| 4,127,338 | 11/1978 | Laybourne | 401/8 |
| 4,509,875 | 4/1985 | Shintani | 401/202 |
| 4,738,556 | 4/1988 | Brown | 401/7 |

FOREIGN PATENT DOCUMENTS

| | | | |
|---|---|---|---|
| 813926 | 6/1937 | France | 401/8 |
| 1214577 | 2/1960 | France | 401/8 |
| 1264621 | 5/1961 | France | 401/7 |
| 2605936 | 5/1988 | France | 401/7 |
| 170823 | 5/1906 | Germany | 15/443 |
| 2461387 | 7/1976 | Germany | 401/7 |
| 1253519 | 11/1971 | United Kingdom | 401/7 |
| 1250478 | 8/1986 | U.S.S.R. | 401/7 |

*Primary Examiner*—Steven A. Bratlie

[57] ABSTRACT

A finger-mounted writing apparatus is disclosed which includes a housing having a forward portion for supporting a writing device extending therefrom and support means associated with the housing for receiving a user's finger and for rigidly supporting the housing relative to the finger. The writing device contacts the writing surface at a writing device contact region. A portion of the fingertip is extended beyond the support means during use, the fingertip being capable of contacting a writing surface at a fingertip contact region. Thus, the fingertip, in combination with the housing of the device, serves to support the writing apparatus during use, the fingertip additionally functioning to guide the motion of the device.

17 Claims, 2 Drawing Sheets

FINGER-MOUNTED WRITING APPARATUS

This is a continuation-in-part of application Ser. No. 07/553,429, filed on Jul. 13, 1990, now abandoned.

BACKGROUND OF THE INVENTION

1. Field of the Invention

The present invention relates to writing devices and particularly relates to a finger-mounted writing apparatus which utilizes the operator's fingertip to support the apparatus during use.

2. Description of the Related Art

Students, clerical help, and many professionals must often spend many hours each day reading through and highlighting books and other documents. Originally, the highlighting markers available for purchase were quite bulky, having diameters often around ¾ inch. In more recent years, thinner markers have been marketed. Highlighting does not require the dexterity associated with pens and pencils, in which the user must have very controlled, guided movements of the instrument. Nevertheless, particularly if used for long periods of time, the usual highlighting marker will become quite tiring to the hand because of the constant and fairly substantial pressure necessary to prevent slipping and sliding of the fingers along the straight, generally cylindrical, surface of the instrument holder.

Additionally, the user will often desire to, not only highlight pages, but also, concurrently, make annotations on the document with a pen or pencil. On such occasions he has to alternatively be putting the marker and pen down, to switch between the pen and the marker.

Although the art is replete with writing devices which have been suggested as solutions for gripping pens none of the prior proposals have met with any significant commercial success. For example, U.S. Pat. No. 4,738,556, entitled "FINGER PEN", issued to J. Brown, discloses a finger-mounted ball point pen which utilizes a padded tray that passes along the ventral side of the index finger, with a padded tip, and a Velcro TM strap which secures the end of the index finger to the tray. Although the Brown device is an aid to arthritic and handicapped persons and also to children, the device does not provide ample support during it's use, there being no provision for accurate guided writing. Instead the user's wrist must be cocked in a stressful position, the finger becoming tired during the use thereof.

U.S. Pat. No. 684,685, entitled "FOUNTAIN PEN", issued to W. Gerst, has similar deficiencies.

Several inventions have been patented which provide support means for assisting the user. For example, U.S. Pat. No. 391,199, entitled "WRITING PEN", issued to C. Seabaugh, discloses a writing implement which uses a thimble, which is adapted to be applied to the forefinger of a hand. The thimble is formed of a length sufficient to cover the end of the finger from its lower joint to the end of the finger nail. One side of the thimble is extended far enough to reach the middle joint of the finger. This extension forms a rest, against which the thumb may rest and thus help to guide and control the pen.

U.S. Pat. No. 488,945, entitled "WRITING DEVICE", issued to A. Nelson, discloses the use of concave plate for supporting the thumb.

U.S. Pat. No. 4,127,338, entitled "WRITING INSTRUMENT", issued to S. Laybourne, discloses an instrument having a gripping section and a rearward support section. The support section tapers outwardly and curves upwardly and is of such length that it nests against and is supported by the inner surface of the index finger of the user while not interfering with normal finger contact on the gripping section. Thus, during use, the Laybourne instrument is supported by the index finger the thumb, and the second finger.

None of the aforementioned patents is directed to a highlighting marker. Furthermore, none of these references effectively minimizes stress during use.

OBJECTS AND SUMMARY OF THE INVENTION

Accordingly, it is a principle object of the present invention, to aid students, clerks, and other users of highlighting markers by providing an efficient, inexpensive, marker which leaves the majority of the hand free to manipulate articles, such as other writing instruments and pages.

Another object is to provide a finger-mounted writing apparatus which allows the pointing finger, to which the device is mounted, to mark the page and concurrently provide support for ease in use and enhanced writing control.

Yet another object of this invention is the provision of a finger-mounted writing apparatus in which the writing unit may be rapidly and easily replaced.

A further object of this invention is to provide an improved writing apparatus which is durable and requires minimal maintenance and which may be easily and quickly mounted on or removed from a finger.

In its broadest aspects, the present invention includes a housing having a forward portion for supporting a writing device extending therefrom and support means associated with the housing for receiving a user's finger and for rigidly supporting the housing relative to the finger. The writing device contacts the writing surface at a writing device contact region. A portion of the fingertip is extended beyond the support means during use, the fingertip being capable of contacting a writing surface at a fingertip contact region. Thus, the fingertip, in combination with the housing of the device, serves to support the writing apparatus during use, the fingertip additionally functioning to guide the motion of the device.

The apparatus provides an efficient means for marking or underlining text. The user simply touches the paper and points to the text while directing the apparatus against the writing surface. The text is marked in an proficient, accurate manner, minimizing fatigue.

Other objects, advantages and novel features of the present invention will become apparent from the following detailed description of the invention when considered in conjunction with the accompanying drawings.

BRIEF DESCRIPTION OF THE DRAWINGS

The same elements or parts throughout the figures of the drawings are designated by the same reference characters.

DETAILED DESCRIPTION OF THE PREFERRED EMBODIMENTS

Figure 1:
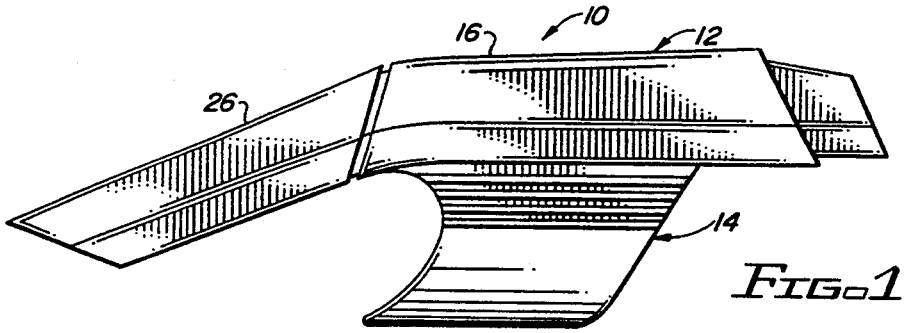
FIG. 1 is a side perspective view of finger mounted writing apparatus of the present invention.

Referring now to the drawings and the characters of reference marked thereon, a preferred embodiment of the finger-mounted writing apparatus of the present invention is designated generally as 10. Apparatus 10 includes a housing 12 and support means 14 bonded to a lower surface of a substantially straight, central portion 16 of the housing 12. Central or main portion 16 includes a chamber for supporting an ink cartridge 18 for a writing device. Housing 12 is preferably formed of molded plastic.

Figure 4:
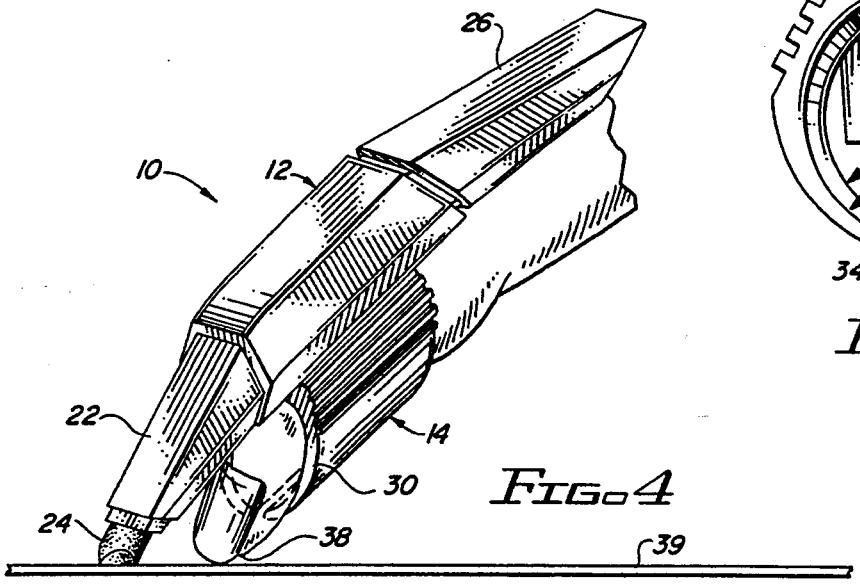
FIG. 4 is a perspective illustration of the present invention, illustrating its use.
Figure 5:
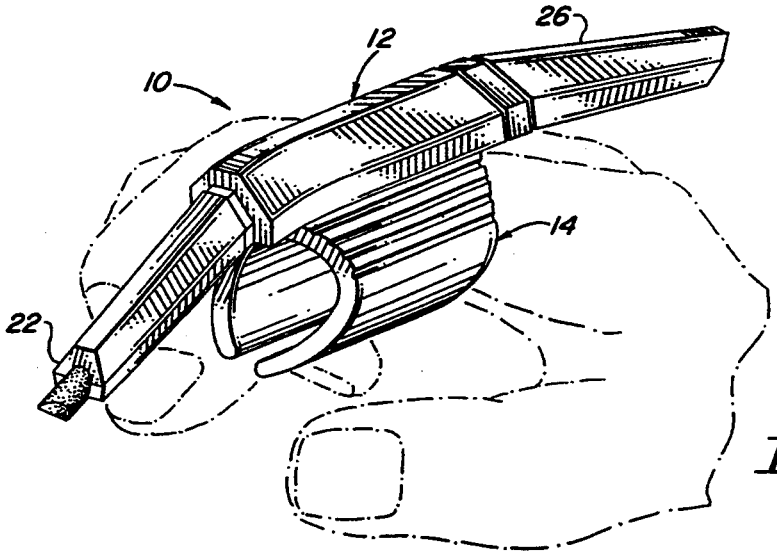
FIG. 5 is another perspective illustration of the present invention, illustrating the user's entire hand.
Figure 6:
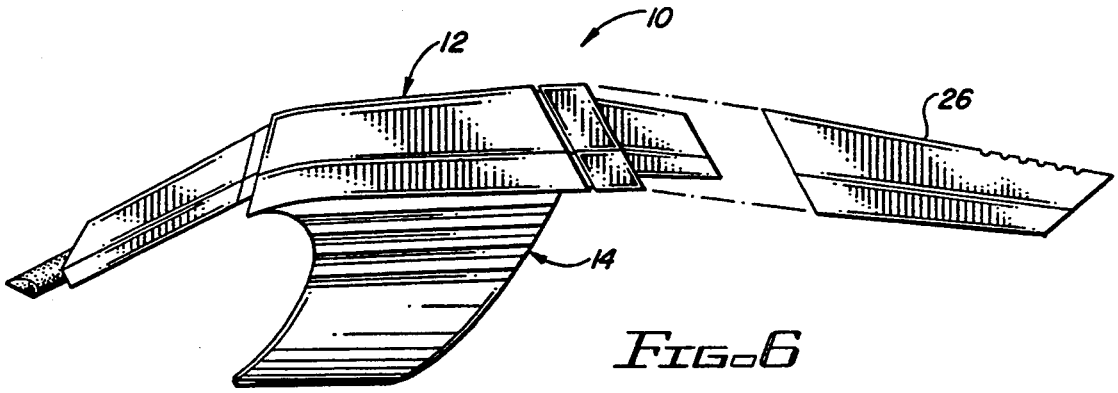
FIG. 6 is a side perspective view of the present invention, illustrating the cap's engagement at the rear end of the apparatus.

A downward bend 20 in the housing 12 is provided to form a forward portion 22. Ink cartridge 18 is flexible at its forward portion so as to conform to bend 20. Forward portion 22 supports a felt tip 24 at its forward end. A cap 26 covers the male forward portion 22 to prevent the tip 24 from drying when the apparatus 10 is not in use. Its application provides a substantially flush surface. A removable, aft portion 28 allows access to the chamber for replacing the ink cartridge 18. Additionally, aft portion 28 serves to hold the cap 26 while the apparatus 10 is in use, as illustrated in FIGS. 4 and 5. Removal of the cap 26 is illustrated in FIG. 6.

The elongated, resilient, unitary support ring 14 (i.e. support means), preferably formed of a semi-rigid plastic or semi-rigid rubber, includes a curved forward end 30 with a forwardly extending longitudinal extension 32 formed by the elliptical curve, for enhanced support. A longitudinal split 34 on the bottom of the support ring 14 is provided for accommodating various sizes of fingers. Support ring 14 may be formed of a thermo-plastic rubber, such as that marketed by Monsanto Corp. under the trademark "SANTOPRENE". Such a material is preferred because it permits the ring to conform to different size fingers.

Figure 2:
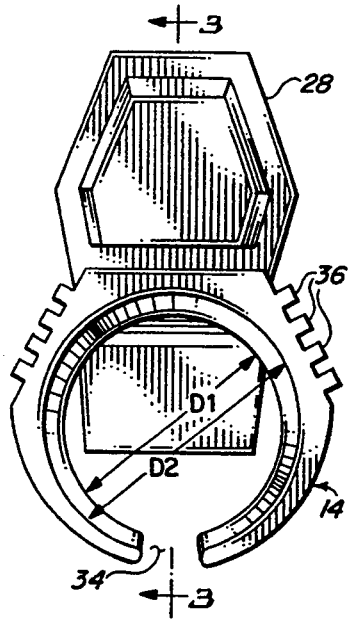
FIG. 2 is an end view, looking forward of the apparatus of FIG. 1.

As best seen in FIG. 2, radially spaced, longitudinal creases 36 are provided on the outer surfaces of lateral sections of the clamp or support ring 14 for maintaining sufficient ring 14 rigidity while concomitantly enhancing the ability for use within a variety of finger sizes. The inner surface of the support ring 14 is tapered so that its diameter D1 at the forward end is slightly smaller than diameter D2 at the aft end. This feature permits suitable mating with the user's finger, which is typically narrower near it tip.

Figure 3:
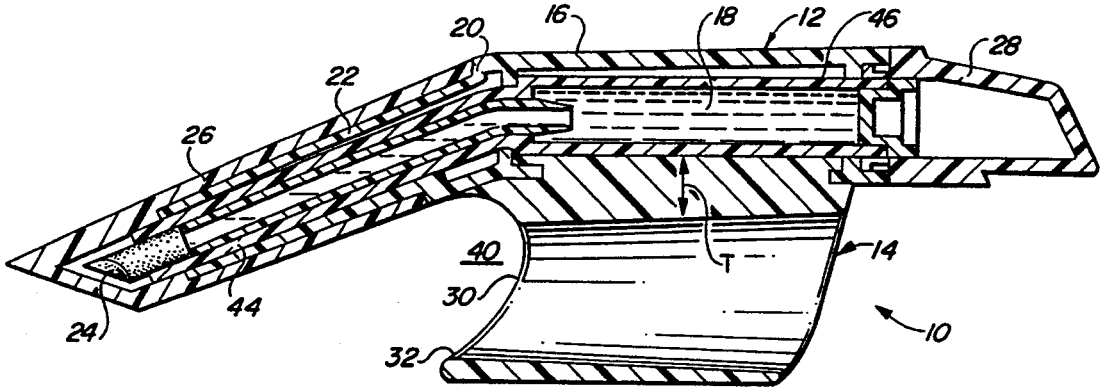
FIG. 3 is a cross-sectional view of the invention, taken along line 3—3 of FIG. 2.

Referring to FIG. 4, during use, a portion of the user's fingertip 38 is extended beyond the forward end 30 of the support ring 14 for contacting the writing surface 39 at a fingertip contact region. Concurrently, the felt tip 24 contacts the writing surface at a writing device contact area. These two points of contact serve to support the writing apparatus, the fingertip therefore both supporting the writing apparatus and guiding it during use. As can be seen by reference to FIG. 3 the support ring 14 has a thickness (denoted by arrows T) at its upper portion so that, as can be seen in FIGS. 4 and 5, the middle phalange of the finger is held in spaced, substantially parallel relationship to the main portion 16 of the apparatus 10.

The thickness, T, of the central part of the upper portion of the support ring is preferably in a range between 0.15 inches and 0.35 inches, preferably about 0.25 inches. The angle formed between the central portion 16 and bent forward portion 22 of the housing 12 is preferably in a range between 15 degrees and 25 degrees, preferably about 20 degrees. The combination of this relative angle and thickness of the upper portion of the support ring serve to provide the desired separation between the fingertip contact region and writing device contact region during use.

Figure 7:
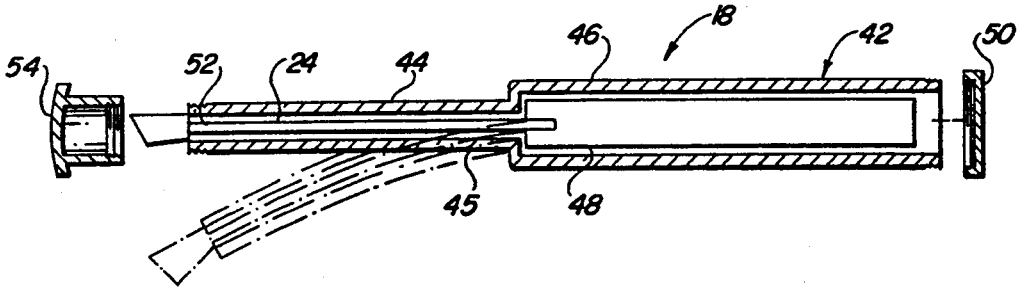
FIG. 7 is a side elevational view, partially in cross-section of an ink cartridge particularly adapted for use with the present apparatus.

Referring now to FIG. 7, an ink cartridge 18 is illustrated which is preferably used with the present invention. Ink cartridge 18 includes a unitary, open-ended, plastic cylindrical reservoir 42. The reservoir 42 has a narrow forward portion 44 and an wide aft portion 46, the aft portion 46 having a diameter greater than the diameter of the forward portion. As can be seen in FIG. 1, the narrow forward portion 44 is positioned at a location in the housing where the forward portion becomes bent, the narrow forward portion 44 being sufficiently narrow to bend in conformance with the forward bend 20 in the housing. An elongated ink storing element 48 is contained within the reservoir, a forward tip 24 of the elongated ink storing element extending beyond the reservoir 42 to form a writing tip. An end cap 50 is securely engageable at an aft opening of the reservoir for refilling. The ink storing element is preferably formed of felt material.

When the ink cartridge is fabricated it is initially straight. However, when it is placed into housing 12 it conforms to the shape of the housing, as illustrated in phantom in FIG. 7. It bends at location 45 where the aft portion 46 joins the forward portion 44.

The forward portion of the plastic reservoir 42 includes ribs 52 on the inner surface of its forward end for providing means for air release when the cartridge is in an unusual pressure environment, such as during airplane flights. A forward end cap 54 is provided when refill cartridges are packaged separate from the writing apparatus. Cap 54 keeps the cartridge 18 from drying before being placed in the writing apparatus. Although the ink cartridge is particularly adapted for use with the finger-mounted apparatus of the present invention, it may also be used in other applications where an ink reservoir must be provided in a housing having a bent end. Furthermore, instead of being used with ink, the forward portion 44 might hold a solid writing material such as lead or crayon. In this instance, the aft portion would function to hold the cartridge 18 in a stationary position. Reservoir 42, could, for example, serve to store spare leads.

The present device has several advantages over a common marking instrument and it addresses several inconveniences and problems with writing instruments in general. It allows the user to hold two writing instruments simultaneously. Common writing instruments are ordinarily used one at a time. The user picks up a pen and writes with it. To use a highlighting marker he usually puts the marker down first. This may cause a break in concentration, misplacement of writing instruments, fatigue, etc. The present invention allows the user to simultaneously hold both a marker and pen, improving his efficiency. It is helpful for handicapped and arthritic persons.

The voids 40 formed on the forward, lateral sections of the support ring 14 by the curved forward end 30 provide enhanced cooperation of the sides of the finger with articles. Thus, for example, the user can easily turn pages in a book without removing the device.

Obviously, many modifications and variations of the present invention are possible in light of the above teachings. It is therefore to be understood that, within the scope of the appended claims, the invention may be practiced otherwise than as specifically described.

For example, although the device has been described for use as a marker this illustrative use is by way of example and not limitation. In this regard, it is emphasized that alternate writing devices may be utilized instead of a felt marker. Thus, it is within the purview of the present invention to use a pen, lead or other writing device in the aforementioned housing. Furthermore, although the present invention has been illustrated as applied to the index finger, it can be applied to any finger. Thus, for example, a user may have a marking apparatus worn on one finger and an apparatus equipped with a pen on another finger.

The housing 12 has been shown in the figures as having a flat upper surface, however, it is noted that the housing can be modified to include novelty items such as figurines, etc.

What is claimed and desired to be secured by Letters Patent of the United States is:

1. A finger-mounted writing apparatus, comprising:

(a) a housing comprising a substantially straight main portion, a forward portion for supporting a writing device extending therefrom, and a removable aft portion, said aft portion being removable to allow the introduction and removal of said writing device from chambers formed within said main portion and forward portion; and (b) support means including an elongated, resilient, unitary support ring securely attached at an upper surface to a lower surface of said main portion of said housing for receiving a user's finger and for rigidly supporting said housing relative to that finger, said support means and said housing cooperating to maintain the middle phalange of that finger in spaced, substantially parallel relationship to said main portion, a portion of the fingertip being extended beyond the support means during use, the fingertip being capable of contacting a writing surface at a fingertip contact region for supporting said writing apparatus during use, the writing device contacting said writing surface at a writing device contact region located forward said fingertip contact region, the fingertip thereby serving to both guide and support the writing apparatus during use, said support ring including a longitudinal split on the bottom thereof to accommodate variously sized fingers, said forward portion of said housing being bent downward with respect to the main portion of said housing so as to conform to the natural curvature of that finger and to optimize the distance between said fingertip contact region and said writing device contact region.

2. The apparatus of claim 1, wherein said support ring is formed of rubber.

3. The apparatus of claim 1, wherein said support ring includes a curved forward end, the bottom of said forward end having a forward extending longitudinal extension formed thereon by said curve, for providing enhanced support.

4. The apparatus of claim 3, wherein voids formed on forward, lateral sections of said support ring by said curved forward end provide enhanced cooperation of the sides of the finger with articles.

5. The apparatus of claim 4, wherein said support ring includes a plurality of radially spaced, longitudinal creases on outer surfaces of said lateral sections for maintaining sufficient support ring rigidity while concomitantly accommodating variously size fingers, said creases being located solely on said outer surfaces.

6. The apparatus of claim 1, wherein said writing device is a highlighting marker.

7. The apparatus of claim 6, wherein a felt tip of the highlighting marker extends from the front end of the forward portion of the housing.

8. The apparatus of claim 7, wherein said forward portion defines a male element for mating with a marker cap.

9. The apparatus of claim 8, wherein said housing further includes a rear portion adjacent to an aft end of said main portion defining a second male element for mating with a cartridge cap, a space located within said main portion for accommodating an ink cartridge.

10. The apparatus of claim 1, wherein said support ring has a thickness at an upper portion thereon in a range between 0.15 inches and 0.35 inches.

11. The apparatus of claim 1, wherein the angle formed between said main portion and said bent forward portion of the housing is preferably in a range between 15 degrees and 25 degrees.

12. The apparatus of claim 1, wherein said support ring includes an inner surface which is tapered so that its diameter at a forward end thereof is slightly smaller than the diameter at an aft end thereof.

13. A finger-mounted writing apparatus, comprising:

(a) a housing for containing a writing device, including, (i) a substantially straight, longitudinal central portion;

(ii) a forward portion integral with said central portion for supporting a writing tip of said writing device, said forward portion being bent downward at an angle with respect to said central portion; and, (iii) a removable aft portion, said aft portion being removable to allow the introduction and removal of said writing device from chambers formed within central portion and forward portion; and, (b) an elongated, resilient, unitary support ring securely attached at an upper surface to a lower surface of said central portion, said support ring having a back end defining an inlet for the introduction of a user's finger and a forward end, a portion of the fingertip being extended beyond the forward end during use, said support ring including a longitudinal split on the bottom thereof to accommodate variously sized fingers, said support ring and said housing cooperating to maintain the middle phalange of that finger in spaced, substantially parallel relationship to said central portion, the bend in the housing for minimizing the distance between the fingertip and the writing device, thereby providing a more direct pointing of the apparatus.

14. The apparatus of claim 13 wherein said forward end is curved, the bottom of said forward end having a forward extending longitudinal extension formed thereon by the curve for providing enhanced support, voids formed on forward, lateral sections of said support ring by said curved forward end providing simultaneous cooperation of the sides of the finger with articles during use of the apparatus.

15. The apparatus of claim 14, therein said support ring includes a plurality of radially spaced, longitudinal creases on said lateral sections for maintaining sufficient support ring rigidity while concomitantly accommodating various size fingers.

16. A finger-mounted highlighting marker, comprising:

(a) a housing for containing a writing cartridge for said marker, including, (i) a substantially straight, longitudinal central portion;

(ii) a forward portion integral with said central portion for supporting a felt tip of said marker, said forward portion being bent downward at an angle with respect to said central portion; and, (iii) a removable aft portion, said aft portion being removable to allow the introduction and removal of said writing device from chambers formed within said central portion and forward portion; and, (b) an elongated, resilient, unitary support ring securely attached at an upper surface to a lower surface of said central portion, said support ring having a back end defining an inlet for the introduction of a user's finger and e forward end, a portion of the fingertip being extended beyond the forward end during use, said support ring including a longitudinal split on the bottom thereof to accommodate variously sized fingers, said support ring and said housing cooperating to maintain the middle phalange of that finger in spaced, substantially parallel relationship to said central portion, the bend in the housing for minimizing the distance between the fingertip and the marker, thereby providing a more direct pointing of the apparatus.

17. The highlighting marker of claim 16 wherein said forward end is curved, the bottom of said forward end having a forward extending longitudinal extension formed thereon by the curve for providing enhanced support, voids formed on forward, lateral sections of said support ring by said curved forward end providing simultaneous cooperation of the sides of the finger with articles during use of the marker.

* * * * *